US008640463B2

(12) United States Patent
Cheung

(10) Patent No.: US 8,640,463 B2
(45) Date of Patent: Feb. 4, 2014

(54) SWIRLER FOR GAS TURBINE ENGINE FUEL INJECTOR

(75) Inventor: Albert K. Cheung, East Hampton, CT (US)

(73) Assignee: United Technologies Corporation, Hartford, CT (US)

( * ) Notice: Subject to any disclaimer, the term of this patent is extended or adjusted under 35 U.S.C. 154(b) by 230 days.

(21) Appl. No.: 13/170,238

(22) Filed: Jun. 28, 2011

(65) Prior Publication Data

US 2013/0000307 A1 Jan. 3, 2013

(51) Int. Cl.
*F02C 1/00* (2006.01)
*F02G 3/00* (2006.01)

(52) U.S. Cl.
USPC ..... 60/748; 60/737; 60/738; 60/739; 60/740; 60/742; 60/743; 60/746; 60/747; 239/399; 239/400; 239/401; 239/402; 239/403; 239/404; 239/405; 239/406

(58) Field of Classification Search
USPC ..... 60/737–748; 239/399–406
See application file for complete search history.

(56) References Cited

U.S. PATENT DOCUMENTS

| | | | | |
|---|---|---|---|---|
| 3,736,746 | A | 6/1973 | DuBell et al. | |
| 5,315,815 | A | 5/1994 | McVey et al. | |
| 5,351,477 | A * | 10/1994 | Joshi et al. | 60/39.463 |
| 5,353,599 | A * | 10/1994 | Johnson et al. | 60/748 |
| 5,603,211 | A * | 2/1997 | Graves | 60/776 |
| 5,941,075 | A | 8/1999 | Ansart et al. | |
| 5,987,889 | A | 11/1999 | Graves et al. | |
| 7,093,445 | B2 | 8/2006 | Corr, II et al. | |
| 7,565,803 | B2 | 7/2009 | Li et al. | |
| 7,581,396 | B2 | 9/2009 | Hsieh et al. | |
| 2009/0056336 | A1 | 3/2009 | Chila et al. | |
| 2010/0251719 | A1 | 10/2010 | Mancini et al. | |
| 2011/0314824 | A1 * | 12/2011 | Cheung | 60/737 |

* cited by examiner

*Primary Examiner* — Andrew Nguyen
*Assistant Examiner* — Craig Kim
(74) *Attorney, Agent, or Firm* — Carlson, Gaskey & Olds, PC

(57) ABSTRACT

A swirler for fuel injection in a gas turbine engine includes a frustoconical swirler body. A first and a second air flow path direct air in generally opposed circumferential directions into the swirler. These air paths intermix and create turbulence. As this turbulence encounters fuel droplets, the fuel is atomized, and uniformly distributed within the air flow. A shear layer is created adjacent an inner surface of the swirler body. In a separate feature, a third air flow path is directed into the air.

18 Claims, 3 Drawing Sheets

SWIRLER FOR GAS TURBINE ENGINE FUEL INJECTOR

BACKGROUND

This application relates to a swirler for a gas turbine engine fuel injector.

Gas turbine engines are known and typically include a compressor which compresses air and delivers the air into a combustor. The air is mixed with fuel, and ignited. Products of this combustion pass downstream over turbine rotors, driving turbine rotors to rotate.

The injection of the fuel and the mixing of the fuel with air are highly engineered processes in gas turbine engine design. Often, the fuel is injected within a conical body known as a swirler. Air may be injected through several paths, and in counter-rotating flow within the swirler.

SUMMARY

In a first feature, a swirler for a gas turbine engine fuel injector includes a frustoconical swirler body extending from an upstream end to a downstream end. A fuel injector extends into the body, and has a downstream end for injecting fuel in a downstream direction. A first air flow path directs air in a first circumferential direction about a central axis of the swirler body. A second flow path extends delivers air to intermix with the air in the first flow path and in a circumferential direction generally opposed to the first circumferential direction. The first flow is provided in a greater volume than the volume provided in the second flow path, and the intermixed first and second flow paths create turbulence which atomizes and entrains fuel, and creates a shear boundary layer along an internal surface of the swirler. This provides good mixing and a generally uniform fuel/air mixture.

In a second feature, first and second flow paths are positioned to inject air upstream of a downstream end of a he fuel injector where fuel is injected. A third flow path injects air into a swirler body at a location that is downstream of the downstream end of the fuel injector. The third flow path is generally in the same circumferential direction as the first flow path. Air is injected in the second flow path generally opposed to the direction of air flow from the first and third air flow paths.

These and other features of the present invention can be best understood from the following specification and drawings, of which the following is a brief description.

DETAILED DESCRIPTION

Figure 1:
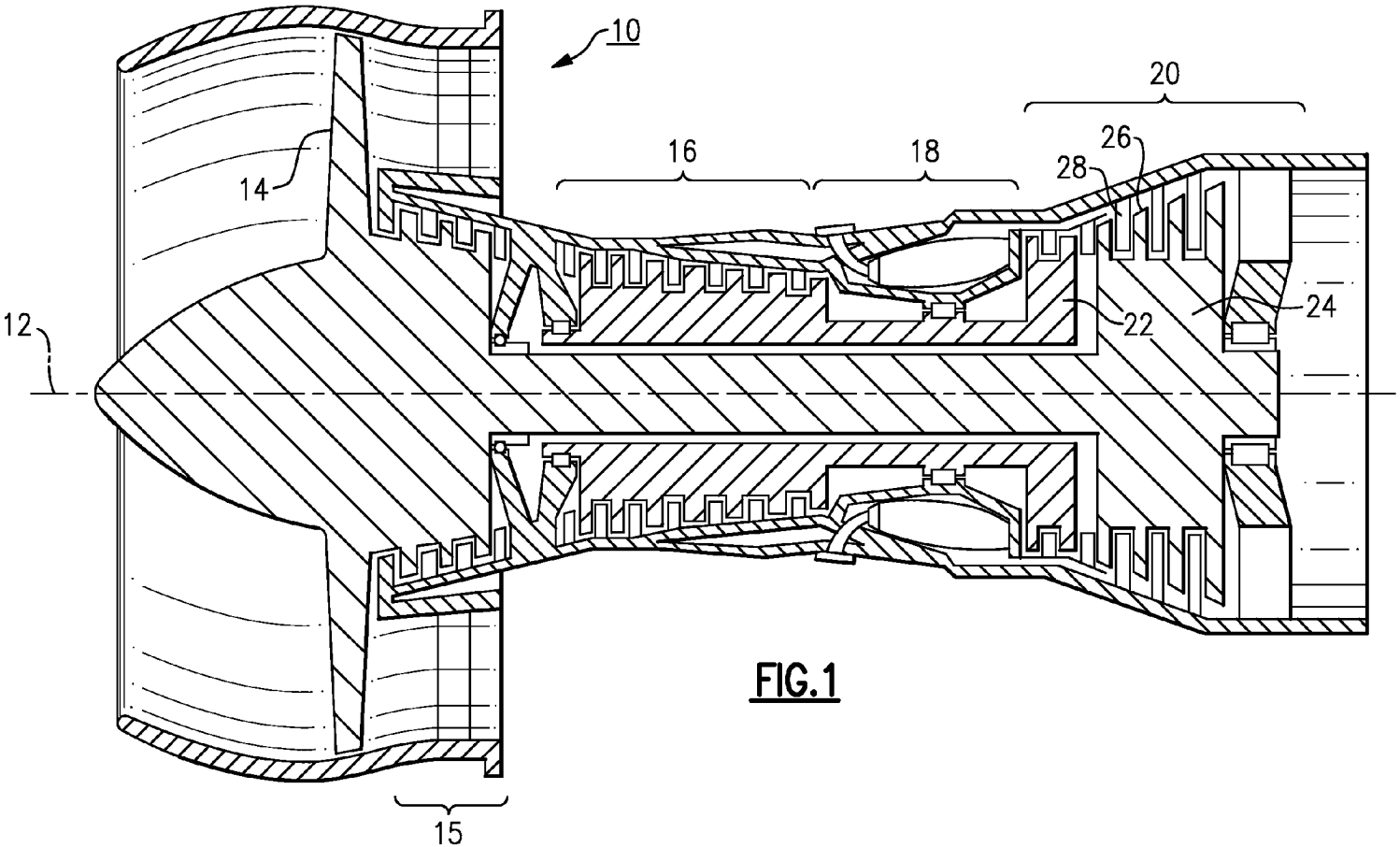
FIG. 1 schematically shows a gas turbine engine.

A gas turbine engine 10, such as a turbofan gas turbine engine, circumferentially disposed about an engine centerline, or axial centerline axis 12 is shown in FIG. 1. The engine 10 includes a fan 14, compressor sections 15 and 16, a combustion section 18 and a turbine section 20. As is well known in the art, air compressed in the compressor 15/16 is mixed with fuel and burned in the combustion section 18 and expanded in turbine 20. The turbine 20 includes rotors 22 and 24, which rotate in response to the expansion. The turbine 20 comprises alternating rows of rotary airfoils or blades 26 and static airfoils or vanes 28. In fact, this view is quite schematic, and blades 26 and vanes 28 are actually removable. It should be understood that this view is included simply to provide a basic understanding of the sections in a gas turbine engine, and not to limit the invention. This invention extends to all types of turbine engines for all types of applications.

Figure 2:
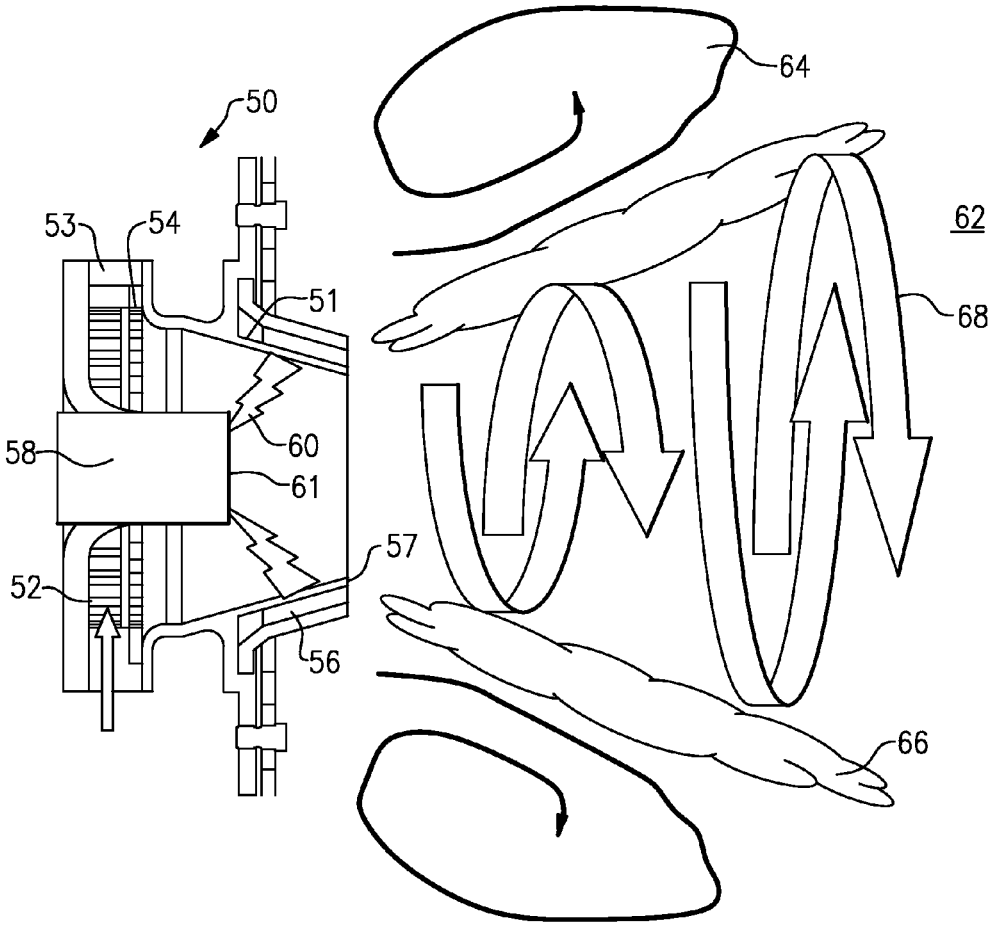
FIG. 2 shows the flow of air, fuel, and the products of combustion in a gas turbine engine combustor.

FIG. 2 shows a portion of the combustion section 18 including a combustor 62 which includes a swirler 50. As known in the art, there are typically a plurality of swirlers spaced circumferentially about a central axis of the engine. Swirler 50 incorporates a fuel injector 58 injecting fuel from a forward, or downstream end 61. In practice, the forward end 61 may be frusto-conical. The interior of body 51 of the swirler 50 is also frusto-conical heading in a downstream director from the fuel injector 58.

A first air path 52 extends through an upstream plate section 53 of the body 51. A second flow path 54 extends just downstream of the flow path 53. A third flow path 56 flows further downstream, and may be called an outer flow.

Fuel is injected as shown schematically at 60. As can be appreciated, flow paths 52 and 54 are upstream of the end 61 while the flow path 56 is downstream of the forward end 61 of the fuel injector. In fact, the flow path 56 leaves the body 51 downstream of an end 57.

Figure 3:
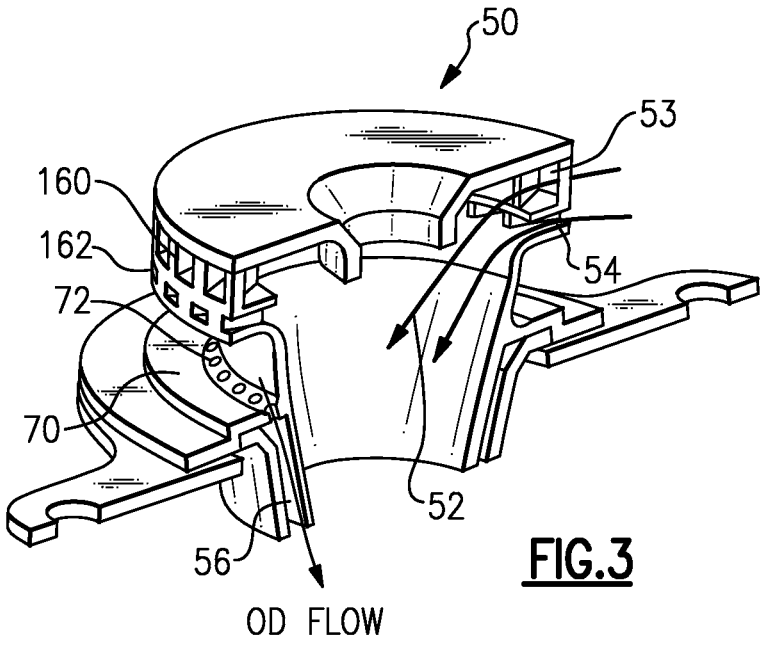
FIG. 3 shows an embodiment of a swirler.

As shown in FIG. 3, the flow path 52 is defined by a plurality of vanes 160. The vanes 160 cause flow in one circumferential direction about a central axis of the swirler 50. Further vanes 162 define the flow path 54. These vanes direct the flow to be in a counter-direction relative to the flow from flow path 52. These two flow paths intermix, and have a high counter-swirling flow which will improve entrainment of the fuel once the intermixed flows reach the injected fuel 60.

The flow through the flow path 56 is shown in FIG. 3 to occur in a forward plate 70 through holes 72. This flow is directed by angling the holes 72 such that the flow path 56 is generally in the same circumferential direction as the flow path 52. It should be understood that the directions of the flow paths 52, 54, and 56 need not be directly opposite, or identically in the same direction. Instead, it is generally true that flow path 52 and 56 are generally in the same circumferential direction, and opposed to the flow path 54. In addition, as can be appreciated from the Figures, each of the three flow paths are defined by a plurality of flow directing members and a plurality of openings. The fact that the claims might refer to "the direction" of flow in any one of the three flow paths should not be interpreted as requiring that there be a single direction of flow across all of these pluralities of flow openings. Rather, there could be a number of varying angles to the flow. However, in general, the circumferential direction provided by the first and third flow path should be generally the same, and opposed to the flow direction of the second flow path.

The first flow is provided in a greater volume than the volume provided in the second flow path, and the intermixed first and second flow paths create turbulence which atomizes and entrains fuel, and creates a shear boundary layer along an internal surface of the body 51. This provides good mixing and a generally uniform fuel/air mixture.

In embodiments, the first flow path will direct a greater volume of air than the second flow path. The ratio of the volume in the first flow path to the volume in the second flow path may be between 1.5-19. In one embodiment, the ratio was 9:1. The ratio of the sum of the first and second paths to the volume of the third path is between 3.0 and 19.0. The sizes of the flow passages that define the flow paths are designed to achieve these volumes.

However, as the fuel and air leaves the ends 57 of the body 51, the fuel can be caused to be thrown radially outwardly due to centrifugal forces. The third flow path 56 again counters this tendency, and ensures the uniform mixture continues downstream into the flame area.

By injecting the third flow path downstream of the end 61, the air in the flow path 56 tends to slow the counter-swirling air, and further ensure proper and more homogeneous mixing of the fuel and air. Thus, as shown at 58, there is little or no vortex breakdown in the swirling air flow, and a more uniform air/fuel distribution. A flame 66 is shown at a shear layer, and the flame and vortex entrain hot products of the combustion as shown schematically at 64. As can be appreciated, the flame 66, the vortex 68, and the products 64 are generally found within the combustor 62.

Figure 4:
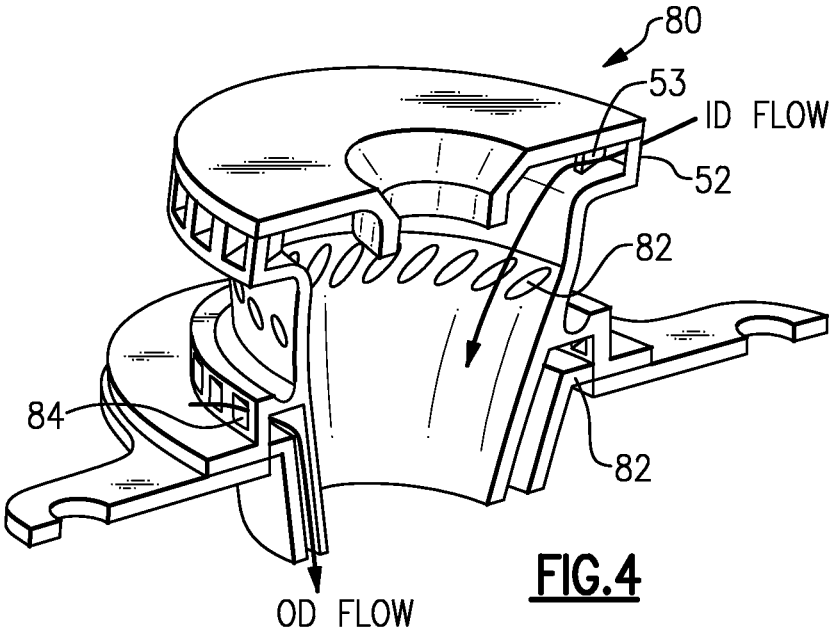
FIG. 4 shows a second embodiment swirler.

FIG. 4 shows an alternative embodiment 80. As can be appreciated, the first flow path 52 is generally the same as in the FIG. 3 embodiment. However, the second flow path 82 is formed further downstream. This location would still be upstream of the end 61 of the injector.

In this embodiment, the third flow path 84 is defined by vanes 84, rather than the holes 72 of the FIG. 3 embodiment. The embodiment of FIG. 4 will operate to provide very similar mixing and flow paths in the combustor as does the FIG. 3 embodiment.

Although embodiments of this invention have been disclosed, a worker of ordinary skill in this art would recognize that certain modifications would come within the scope of this invention. For that reason, the following claims should be studied to determine the true scope and content of this invention.

What is claimed is:

1. A swirler for a gas turbine engine fuel injector comprising:

a frustoconical swirler body extending from an upstream end to a downstream end, a fuel injector extending into the body, and having a downstream end for injecting fuel in a downstream direction;

a first flow path for directing air in a first circumferential direction about a central axis of the swirler body;

a second flow path directing air to intermix with the air in the first flow path, and then to mix with fuel injected by the fuel injector, said first and second flow paths being positioned to inject air upstream of the downstream end of the fuel injector where fuel is injected;

said first flow path is provided in a greater volume than the volume provided in the second flow path, and the intermixed first and second flow paths create turbulence to atomize and entrain fuel; and said second flow path directing air at a location downstream of said first flow path.

2. The swirler as set forth in claim 1, wherein a ratio of volume of air in the first air flow path to the volume of air in the second flow path is between 1.5 and 19.

3. The swirler as set forth in claim 1, wherein a third air flow path injects air to intermix with the air in the first and second flow paths downstream of the downstream end of the fuel injector, and the third air flow path being in a circumferential direction generally the same as the first circumferential direction.

4. The swirler as set forth in claim 3, wherein said third air flow path mixes with said first and second air flow path at a location downstream of a downstream end of the swirler body.

5. The swirler as set forth in claim 4, wherein said third air flow path is defined by holes drilled at an angle to direct air in the desired direction.

6. The swirler as set forth in claim 4, wherein said third air flow path is defined by vanes which direct air in the desired direction.

7. The swirler as set forth in claim 4, wherein a ratio of the sum of the volumes of air in the first and second flow paths to the volume in the third flow path is between 3.0 and 19.0.

8. The swirler as set forth in claim 1, wherein said first and second air flow paths are provided by vanes which direct air in the opposed directions.

9. A swirler for a gas turbine engine comprising:

a swirler body extending from an upstream end to a downstream end, a fuel injector extending into the body, and having a downstream end for injecting fuel in a downstream direction;

a first flow path for delivering air in a first circumferential direction about a central axis of the swirler body;

a second flow path delivering air to intermix with the air in the first flow path, and then to mix with fuel injected by the fuel injector, said first and second flow paths mixing air upstream of the downstream end of the fuel injector;

said first flow path is provided in a greater volume than the volume provided in the second flow path, and the intermixed first and second flow paths create turbulence to atomize and entrain fuel;

said second flow path directing air at a location downstream of said first flow path; and a third flow path injecting air downstream of the downstream end of the fuel injector, and said third flow path being generally in the same circumferential direction as said first flow path, and the air injected in the second flow path being generally opposed to the direction of air flow from the first and third air flow paths.

10. The swirler as set forth in claim 9, wherein said swirler body has a plate at an upstream end which includes air flow components for defining at least said first air flow path.

11. The swirler as set forth in claim 10, wherein said plate further includes air flow directing components for defining said second air flow path.

12. The swirler as set forth in claim 9, wherein said swirler body includes a frusto-conical portion extending toward a smaller diameter portion at a downstream end of said swirler body.

13. The swirler as set forth in claim 12, wherein said third flow path mixes with the first and second air flow paths downstream of the downstream end of the swirler body.

14. The swirler as set forth in claim 13, wherein said third air flow path includes holes drilled at an angle which directs air in the desired direction.

15. The swirler as set forth in claim 13, wherein said third air flow path is defined by vanes which direct air in the desired direction.

16. The swirler as set forth in claim 9, wherein said first and second air flow paths are defined by vanes which direct air in the opposed directions.

17. The swirler as set forth in claim 9, wherein a ratio of volume of air in the first air flow path to the volume of air in the second flow path is between 1.5 and 19.

18. The swirler as set forth in claim 9, wherein a ratio of the sum of the volumes of air in the first and second flow paths to the volume in the third flow path is between 3.0 and 19.0.

* * * * *